US010718134B1

(12) United States Patent
Dory

(10) Patent No.: US 10,718,134 B1
(45) Date of Patent: Jul. 21, 2020

(54) GATE LATCH ACCESSORY AID

(71) Applicant: Kenneth S. Dory, Calgary (CA)

(72) Inventor: Kenneth S. Dory, Calgary (CA)

( * ) Notice: Subject to any disclaimer, the term of this patent is extended or adjusted under 35 U.S.C. 154(b) by 760 days.

(21) Appl. No.: 15/359,962

(22) Filed: Nov. 23, 2016

Related U.S. Application Data

(60) Provisional application No. 62/259,093, filed on Nov. 24, 2015.

(51) Int. Cl.

| | |
|---|---|
| ***E05B 1/00*** | (2006.01) |
| ***E05B 17/00*** | (2006.01) |
| ***E05B 65/00*** | (2006.01) |
| ***E05B 53/00*** | (2006.01) |

(52) U.S. Cl.
CPC ..... *E05B 1/0061* (2013.01); *E05B 17/002* (2013.01); *E05B 53/003* (2013.01); *E05B 65/0007* (2013.01); *Y10T 292/0911* (2015.04); *Y10T 292/0926* (2015.04); *Y10T 292/0931* (2015.04); *Y10T 292/0934* (2015.04); *Y10T 292/0945* (2015.04); *Y10T 292/0951* (2015.04); *Y10T 292/0953* (2015.04); *Y10T 292/1078* (2015.04); *Y10T 292/1085* (2015.04); *Y10T 292/57* (2015.04)

(58) Field of Classification Search
CPC ..... Y10T 292/0911; Y10T 292/0953; Y10T 292/0931; Y10T 292/0992; Y10T 292/1078; Y10T 292/1051; Y10T 292/1059; Y10T 292/696; Y10T 292/1071; Y10T 292/0945; Y10T 292/0959; Y10T 292/0933; Y10T 292/0994; Y10T 292/1083; Y10T 292/1052; Y10T 292/106; Y10T 292/0951; Y10T 292/0926; Y10T 292/0934; Y10T 292/1043; Y10T 292/1084; Y10T 292/1055; Y10T 292/1061; Y10T 292/702; Y10T 292/0952; Y10T 292/0928; Y10T 292/1017; Y10T 292/1075; Y10T 292/1085; Y10T 292/1057; Y10T 292/1069; Y10T 292/57; E05B 1/0061; E05B 17/002; E05B 53/003; E05B 65/0007
See application file for complete search history.

(56) References Cited

U.S. PATENT DOCUMENTS

| | | | | |
|---|---|---|---|---|
| 201,675 A * | 3/1878 | Hollingsworth | E05B 53/003 | 292/235 |
| 257,986 A * | 5/1882 | Skerrett | E05C 17/365 | 292/264 |
| 540,911 A * | 6/1895 | George | E05B 53/003 | 292/38 |
| 762,481 A * | 6/1904 | Klipping | E06B 9/521 | 160/328 |
| 842,535 A * | 1/1907 | Durant | E05B 65/0007 | 292/120 |

(Continued)

*Primary Examiner* — Kristina R Fulton
*Assistant Examiner* — Faria F Ahmad
(74) *Attorney, Agent, or Firm* — Cramer Patent & Design, PLLC; Aaron R. Cramer

(57) ABSTRACT

A gate latch accessory aid is fashioned as an arcuate tube, tubes, half-pipe or half-pipes having a rectangular mounting plate or plates located at each end. The gate latch accessory aid is fence post-mountable and provides smooth operation of a gate latching mechanism. The aid provides protection of actuating rope/cable and wooden portions of the gate guide system.

10 Claims, 8 Drawing Sheets

(56) References Cited

U.S. PATENT DOCUMENTS 890,518 A * 6/1908 Kleidmann ..... E05C 17/365 292/264
912,379 A * 2/1909 Jackson ..... E05B 53/003 292/38
1,267,307 A * 5/1918 Becker ..... E05B 53/003 49/301
1,328,979 A * 1/1920 Becker ..... E05B 53/003 49/301
1,387,914 A * 8/1921 Thompson ..... E05B 65/0007 292/173
1,547,833 A * 7/1925 Smith ..... E05B 65/0007 292/255
1,688,543 A * 10/1928 Highers ..... B62D 33/0273 292/106
1,933,751 A 11/1933 Nelson
2,238,266 A * 4/1941 Martin ..... E05B 53/003 70/478
2,724,605 A * 11/1955 Pfullman ..... A01K 1/0017 292/36
2,770,482 A * 11/1956 Kusiek ..... E06B 11/021 292/246
2,809,064 A * 10/1957 Meyer ..... E05B 83/24 292/226
3,083,562 A * 4/1963 Weizer ..... E05B 43/005 70/271
3,266,831 A * 8/1966 Banse ..... E05C 3/24 292/133
3,433,518 A * 3/1969 Foltz ..... E05C 3/24 292/238
3,463,529 A * 8/1969 Rubbio ..... E05B 83/24 292/106
3,473,598 A * 10/1969 Leighty ..... E06B 11/021 160/328
4,402,489 A 9/1983 Murray
4,702,094 A * 10/1987 Peterson ..... E05B 47/0603 180/289
4,877,673 A 10/1989 Eckel et al.
4,938,508 A * 7/1990 Thomas ..... E05C 3/047 292/106
4,993,759 A * 2/1991 Thomas ..... E05C 3/047 292/106
5,018,302 A * 5/1991 Kluge ..... E05B 65/1033 292/304
5,020,840 A * 6/1991 Winter ..... A01K 1/0017 24/701
5,076,080 A * 12/1991 Fuss ..... E05C 3/042 292/66
5,078,438 A * 1/1992 Bieganski ..... E05B 17/2007 292/209
5,174,063 A * 12/1992 Lewis ..... E05B 65/1033 49/141
5,181,402 A * 1/1993 Faessler ..... B65D 63/08 24/16 PB
5,205,022 A * 4/1993 Norton ..... F16L 3/04 24/276
5,219,384 A * 6/1993 Elsfelder ..... E05B 67/38 70/18
5,358,292 A 10/1994 Van Wiebe et al.
5,509,233 A * 4/1996 Peterson ..... E05B 53/003 49/139
5,595,073 A * 1/1997 Sullivan ..... E05B 17/002 70/159
5,626,375 A * 5/1997 Plett ..... E05B 65/0007 292/136
5,632,514 A * 5/1997 Johnson, Jr. ..... E05B 65/0014 292/95
5,655,801 A * 8/1997 Casey ..... E05B 65/0007 292/210
6,170,892 B1 1/2001 Lantiegne
6,511,138 B1 * 1/2003 Gardner ..... E05B 65/462 312/217
7,021,678 B1 * 4/2006 Raoult ..... A01K 1/0017 256/1
7,086,351 B1 * 8/2006 Michalek ..... A01K 1/0017 119/524
7,431,547 B2 10/2008 Geary et al.
8,272,625 B1 * 9/2012 Bassett ..... E05C 19/184 16/230
8,465,063 B1 * 6/2013 Jones ..... E05B 65/0007 292/264
8,636,308 B2 1/2014 Calamia, III
8,746,754 B2 * 6/2014 Shute ..... E05B 47/004 292/137
8,764,076 B2 * 7/2014 Glover ..... E05C 3/30 292/225
8,820,802 B1 * 9/2014 Dodson ..... E05B 65/0007 292/1
9,038,353 B2 * 5/2015 Huncovsky ..... E04G 23/02 52/835
9,528,306 B2 * 12/2016 Wepf ..... E05B 17/2038
9,926,108 B2 * 3/2018 Wiley ..... B65D 33/00
10,370,871 B2 * 8/2019 Garrow
2004/0130164 A1 * 7/2004 Burch ..... A01K 1/0017 292/246
2006/0248979 A1 * 11/2006 Gephart ..... E05B 65/0007 75/10.59
2007/0120377 A1 * 5/2007 King ..... E05C 17/60 292/163
2009/0217715 A1 * 9/2009 Bray ..... E05B 65/0007 70/158
2011/0254289 A1 * 10/2011 Calamia, III ..... E05B 53/003 292/336.3
2011/0272654 A1 11/2011 Fay et al.
2012/0111068 A1 * 5/2012 Pasky ..... E05B 17/002 70/56
2012/0274081 A1 * 11/2012 Frazier ..... E05B 65/0007 292/137
2013/0341939 A1 * 12/2013 Glover ..... E05C 3/16 292/341.17
2014/0013667 A1 * 1/2014 Amagai ..... E05B 79/20 49/301
2014/0042378 A1 * 2/2014 Lankford ..... E05B 65/0007 254/264
2014/0339835 A1 * 11/2014 Wepf ..... E05B 17/2038 292/196
2016/0376820 A1 * 12/2016 Glover ..... E05C 3/16 292/235
2017/0009489 A1 * 1/2017 Steinman ..... E05B 65/0003
2018/0238084 A1 * 8/2018 Weber ..... E05C 3/165
2018/0298637 A1 * 10/2018 Johnson ..... E05B 19/20
2018/0320415 A1 * 11/2018 Yang ..... E05B 65/0007
2019/0112848 A1 * 4/2019 Carter ..... E05B 65/0007
2019/0186199 A1 * 6/2019 Klimek ..... E06B 11/025

* cited by examiner

GATE LATCH ACCESSORY AID

RELATED APPLICATIONS

The present invention was first described in and claims the benefit of U.S. Provisional Application No. 62/259,093 filed Nov. 24, 2015, the entire disclosures of which are incorporated herein by reference.

FIELD OF THE INVENTION

The present invention relates generally to a gate latch accessory aid to provide protection of cable and wooden portions of a gate.

BACKGROUND OF THE INVENTION

Fence gates are used to provide access in and out of enclosed areas. While small gates which permit personnel access are easy to install and use, larger gates such as those across driveways are somewhat more difficult to design and implement. Many times, such gates are provided in two (2) parts which swing back and forth to allow vehicles and other large objects to pass. It is necessary to secure these two (2) part gates in the middle when they are closed.

Other fence gate latches utilize a generally "U"-shaped member having a base which pivots about a supporting fence post such that the "U"-shaped portion engages the gate post in a lowered position and disengages the gate post in a raised position so the gate can be opened. Still other types of latching mechanisms utilize a latch bar and a corresponding spring-loaded catch.

However, a significant number of fence gates are secured with similar devices by means of a rope, or a cable. Often, when pulled as taut as possible, the rope can fray on the fence post, or the gate itself. In the case of a sturdy and resilient device such as a cable is used, such a taut installation and securing of the fence gate may dig into and deface or deform the fence post, particularly if it is fabricated out of wood.

Thus, a need exists for a reliable accessory aid to protect the fence post and the rope or cable from destruction, and to avoid the above-mentioned problems.

SUMMARY OF THE INVENTION

The inventor has recognized the aforementioned inherent problems and lack in the art and observed that there is a need for a reliable accessory aid to protect the fence post and the rope or cable from destruction.

It is therefore an object of the invention to provide a gate latch accessory aid which comprises of a first mounting bracket that is adapted to be mounted to a first top side edge of a fence post, a second mounting bracket that is adapted to be mounted to a second top side edge of the fence post and positioned opposite the first mounting bracket, a guide which has a first end that is secured to a top side face of the first mounting bracket and a second end that is secured to a top side face of the second mounting bracket while spanning a distance between the first mounting bracket and the second mounting bracket, a post eyelet which is adapted to be mounted to a fence post first side and subjacent to the first mounting bracket which is capable of enabling routing a cable therethrough and a latching mechanism which is adapted to be mounted to a fence post second side opposite the post eyelet and subjacent from the second mounting bracket. The latching mechanism also has a latch eyelet which can retain a distal end of the cable while the guide is adapted to support and allow free motioning of the cable. The guide is adapted to support and allow free motioning of the cable.

The gate latch accessory aid may also comprise of a first gusset which further secures the guide first end to the top side face of the first mounting bracket and a second gusset which further secures the guide second end to the top side face of the second mounting bracket. The guide may comprise either a tubular member having an upward arch or a half-pipe member likewise having an upward arch. Both configurations can support the cable. The first mounting bracket and the second mounting bracket may each comprise an "L"-shape.

The gate latch accessory aid may also comprise of a first tongue which is secured upon a top side face corner of the first mounting bracket while being subjacent the guide first end and a second tongue which is secured upon a top side face corner of the second mounting bracket and subjacent the guide second end.

In an alternate configuration, the gate latch accessory aid may comprise of a first mounting bracket which is adapted to be mounted to a first top side edge of a fence post, a second mounting bracket which is adapted to be mounted to a second top side edge of the fence post opposite the first mounting bracket, a first guide which has a first end secured to a top side face of the first mounting bracket and a second end, a second guide which has a first end secured to a top side face of the second mounting bracket and a second end positioned mirror opposite the first guide tube, a post eyelet which is adapted to be mounted to a fence post first side and subjacent to the first mounting bracket which is capable of enabling routing a cable therethrough and a latching mechanism which is adapted to be mounted to a fence post second side opposite the post eyelet and subjacent from the second mounting bracket. The latching mechanism also has a latch eyelet which can retain a distal end of the cable while the guide is adapted to support and allow free motioning of the cable. The first and second guides are adapted to support and allow free motioning of the cable therethrough while spanning the open distance between each guide.

With respect to this embodiment, the gate latch accessory aid may also comprise of a first gusset which further secures the first guide first end to the top side face of the first mounting bracket, a second gusset which further secures the second guide first end to the top side face of the second mounting bracket, a first tongue which is secured upon a top side face corner of the first mounting bracket while also being subjacent to the first guide first end and a second tongue which is secured upon a top side face corner of the second mounting bracket while being subjacent the second guide first end. The first and second guides comprise either a tubular member having an upward arch, configured to enable the insertion of the cable or a half-pipe member likewise having an upward arch, configured to enable the support of the cable. The first and second mounting brackets may each comprise an "L"-shape.

In yet an additional alternate configuration, the gate latch accessory aid may comprise a mounting bracket which has a first side and second side which is adapted to be mounted to a first top side edge of a fence post, a guide which has a first end that is secured to a top side face of the mounting bracket first side and a second end which is secured to a top side face of the mounting bracket second side, a post eyelet which is adapted to be mounted to a fence post first side while being subjacent to the first mounting bracket which is capable of enabling a routing of a cable therethrough and a latching mechanism which is adapted to be mounted to a fence post second side opposite the post eyelet and subjacent from the second mounting bracket. The latching mechanism also has a latch eyelet which can retain a distal end of the cable while the guide is adapted to support and allow free motioning of the cable. The guide is adapted to support and allow free motioning of the cable.

In this embodiment, gate latch accessory aid may also comprise a first gusset which further secures the guide first end to the top side face of the mounting bracket first side, a second gusset which further secures the guide second end to the top side face of the mounting bracket second side, a first tongue which is secured upon a top side face corner of the mounting bracket first side and is subjacent the guide first end and a second tongue which is secured upon a top side face corner of the mounting bracket second side and is subjacent the guide second end. The guide comprises either a tubular member having an upward arch, which is configured to enable the insertion of the cable or a half-pipe member which likewise has an upward arch, which is configured to enable the support of the cable. The mounting bracket may comprise a "C"-shape. The mounting bracket, the guide, the first gusset, the second gusset, the first tongue and the second tongue may be integrally molded.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
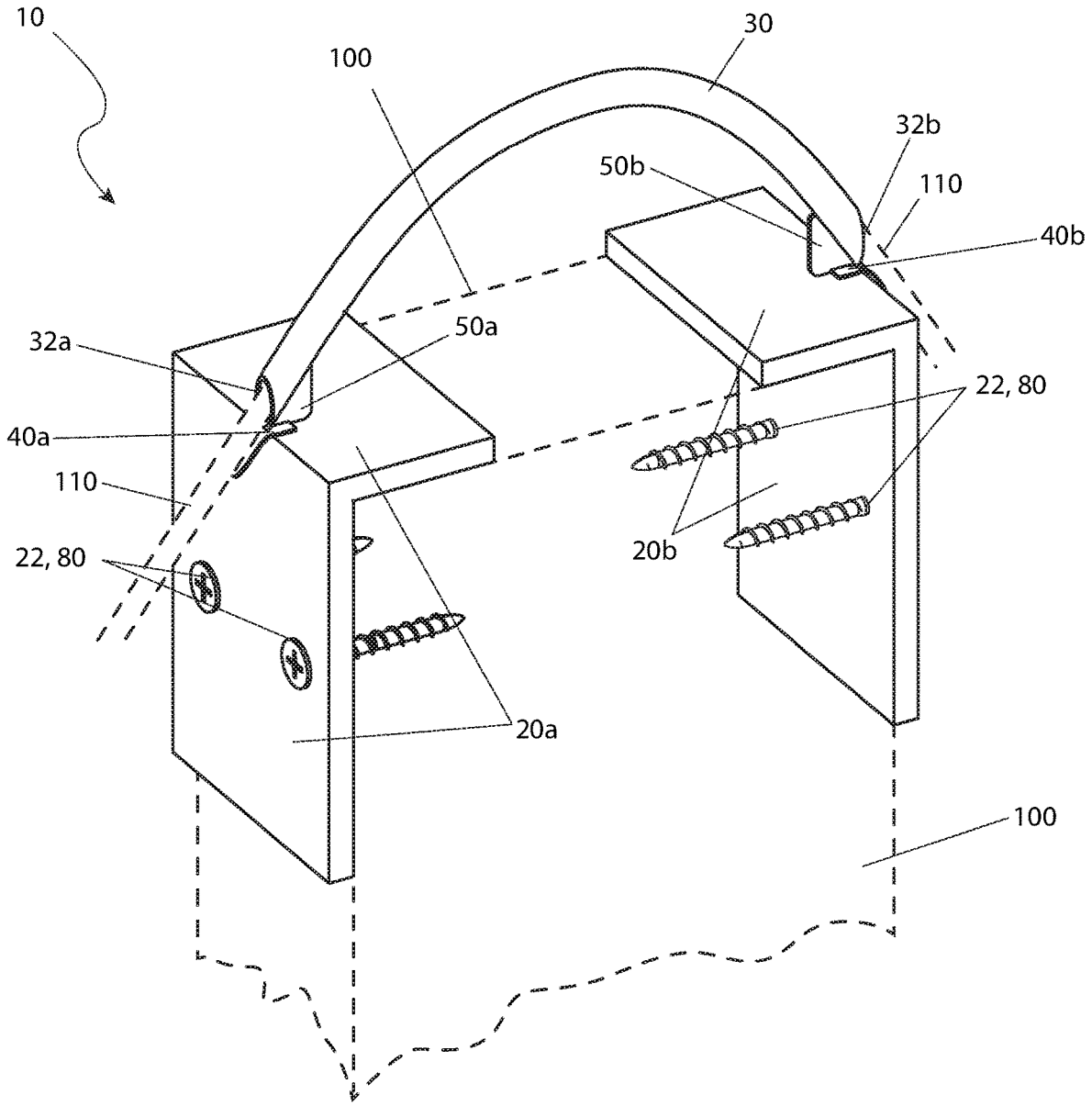
FIG. 1 is a perspective view of a gate latch accessory aid 10, according to a preferred embodiment of the present invention.

10 gate latch accessory aid
11 first alternate embodiment
12 second alternate embodiment
13 third alternate embodiment
14 fourth alternate embodiment
15 fifth alternate embodiment
16 sixth alternate embodiment
20*a* first mounting bracket
20*b* second mounting bracket
20*c* third mounting bracket
21*a* mounting bracket first side
21*b* mounting bracket second side
22 fastener aperture
30 guide tube
31*a* first guide tube
31*b* second guide tube
31*c* first guide tube first aperture
31*d* first guide tube second aperture
31*e* second guide tube first aperture
31*f* second guide tube second aperture
32*a* guide tube first aperture
32*b* guide tube second aperture
33 half-pipe guide
33*a* first half-pipe guide
33*b* second half-pipe guide
40*a* first tongue
40*b* second tongue
50*a* first gusset
50*b* second gusset
80 fastener
100 fence post
110 rope/cable
120 post eyelet
130 latch
132 latch eyelet
134 latch hook
136 latch mounting plate

DETAILED DESCRIPTION OF THE PREFERRED EMBODIMENT

Figure 2:
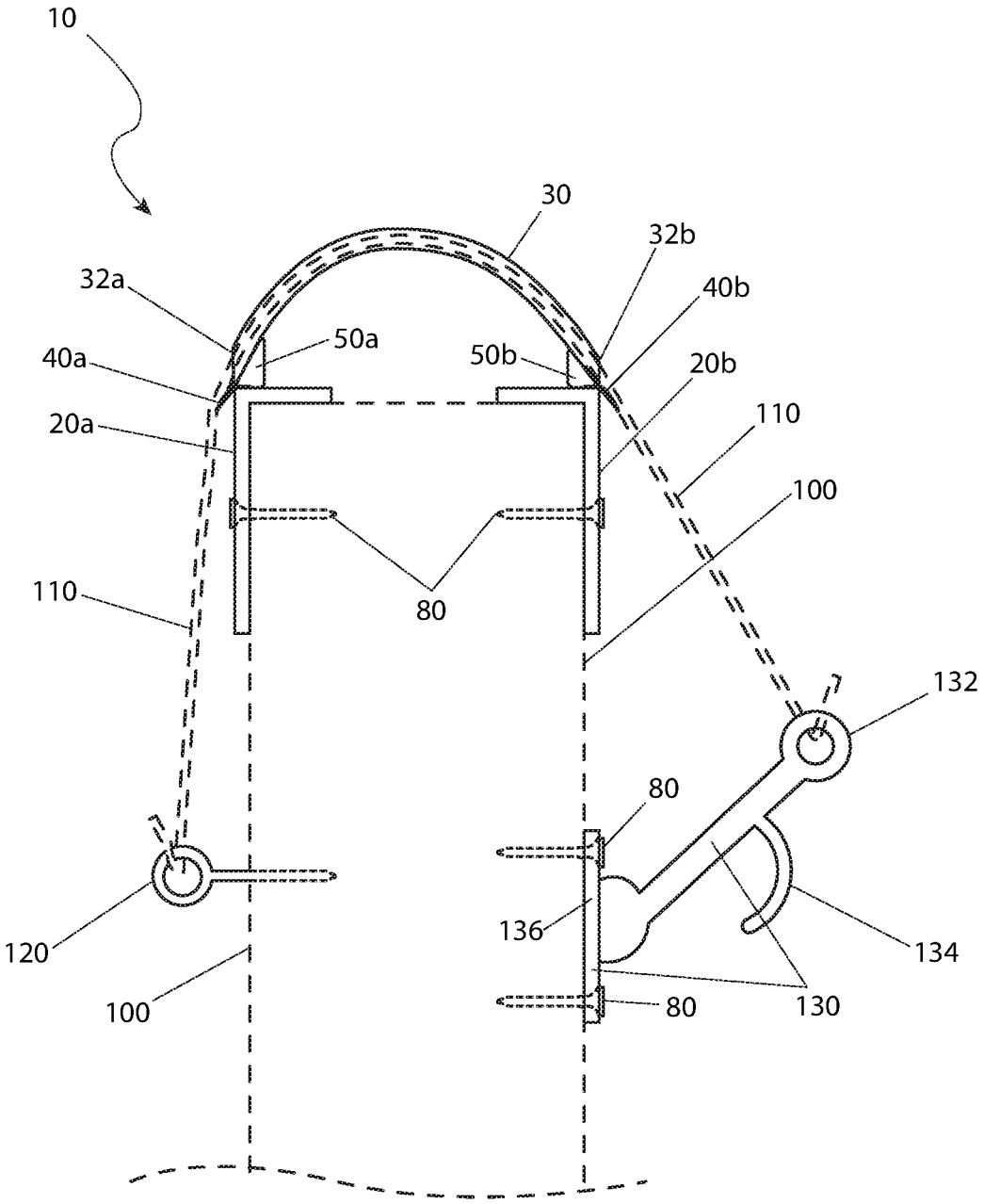
FIG. 2 is an environmental side view of the gate latch accessory aid 10, according to a preferred embodiment of the present invention.

The best mode for carrying out the invention is presented in terms of its preferred embodiment, herein depicted within FIGS. 1 and 2. However, the invention is not limited to the described embodiment (as detailed in FIGS. 3-8) and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a gate latch accessory aid (herein described as the "device") in the preferred embodiment 10 and alternate embodiments 11-16, which provide a post-mountable accessory to aid in the smooth operation of a latch mechanism 130 also mounted to the fence post 100. The devices in the preferred embodiment 10 and alternate embodiments 11-16, provide protection of wooden gate portions as well as protection of an actuating rope/cable portion 110 from sharp edges, thereby extending a life of the rope cable 110.

Referring now to FIG. 1, a perspective view of the device 10, according to the preferred embodiment of the present invention, is disclosed. The device 10 includes a unitary plastic or metal structure including a first mounting bracket 20*a*, a mirror-image second mounting bracket 20*b*, and an interconnecting hollow guide tube 30. The mounting brackets 20*a*. 20*b* are envisioned to take on mirror-image "L"-shaped forms for convenient positioning and attachment along opposing top edge portions of an existing fence post 100. The parallel vertical portions of the mounting brackets 20*a*, 20*b* include a plurality of formed or machined fastener apertures 22 allowing the device 10 to be affixed to the fence post 100 using corresponding fasteners 80 such as wood screws, lag screws, or the like. The guide tube 30 is affixed to, and extends between opposing top corner portions of the mounting brackets 20*a*, 20*b* in an upwardly arcing manner, being welded or otherwise permanently joined thereto. The hollow guide tube 30 provides a pair of internal guide tube apertures 32*a*, 32*b* through its length, being sized so as to allow insertion and free motioning of a rope/cable 110 through the guide tube 30 during use (see FIG. 2). It is envisioned that the device 10 may be sold in different sizes having different widths between the brackets 20*a*, 20*b* to fit snuggly upon various standard sizes of fence posts 100 such as four by four inches (4×4 in.), four by six inches (4×6 in.), and the like.

A pair of tongues 40*a*, 40*b*, each of which is located at the transition of the angle portion of each of the mounting brackets 20*a*, 20*b*, directly subjacent to a distal exit port of the guide tube 30. The tongues 40*a*, 40*b* exist to help further create a smooth and non-fraying contact point for the rope/cable 110. Also, a pair of gusset plates 50*a*, 50*b*, each of which is positioned to help support a distal end of the guide tube 30 to the upper horizontal portions for a respective mounting bracket 20*a*, 20*b*.

Figure 5:
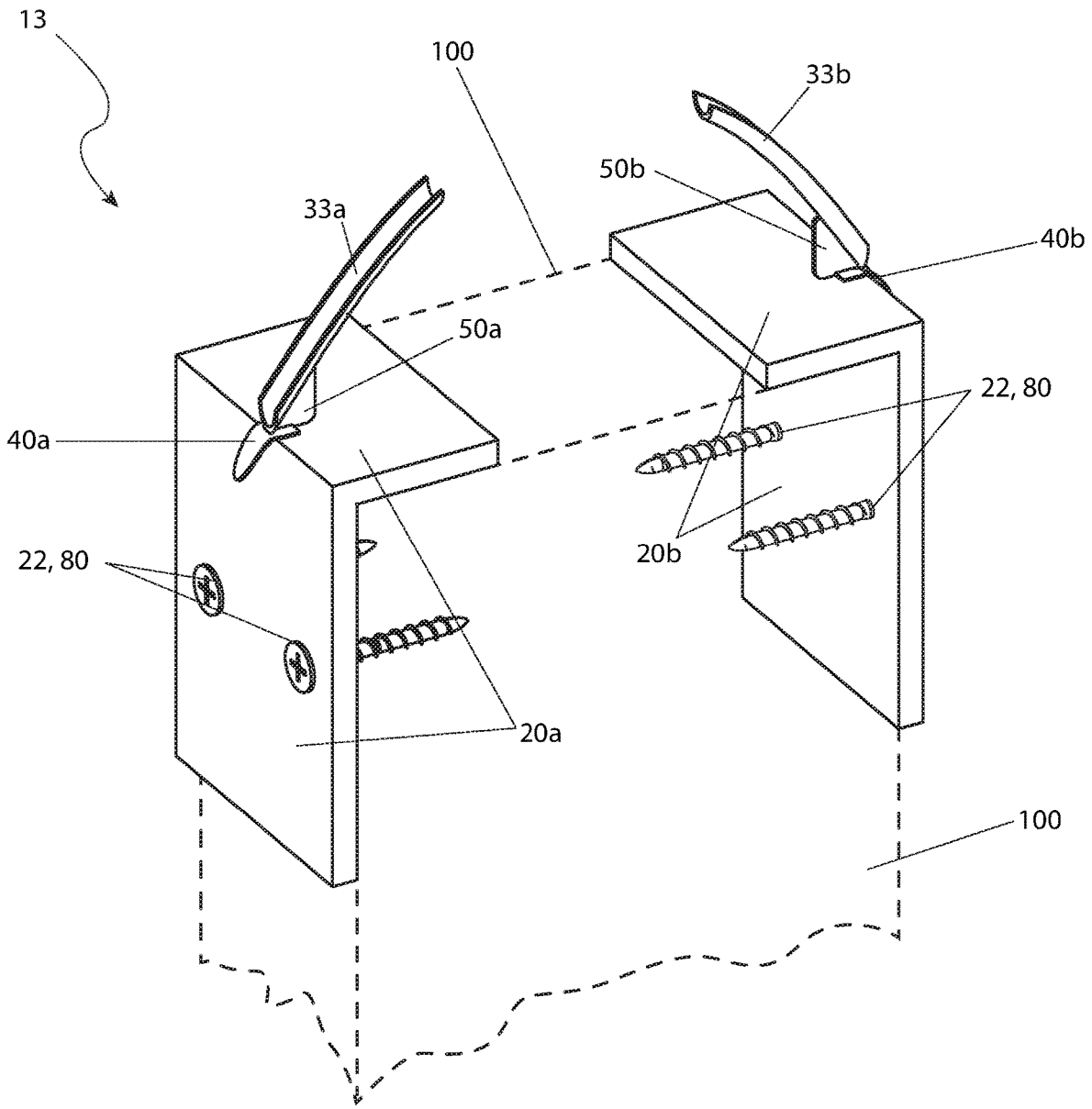
FIG. 5 is a perspective view of a gate latch accessory aid 13, according to a third alternate embodiment of the present invention.
Figure 6:
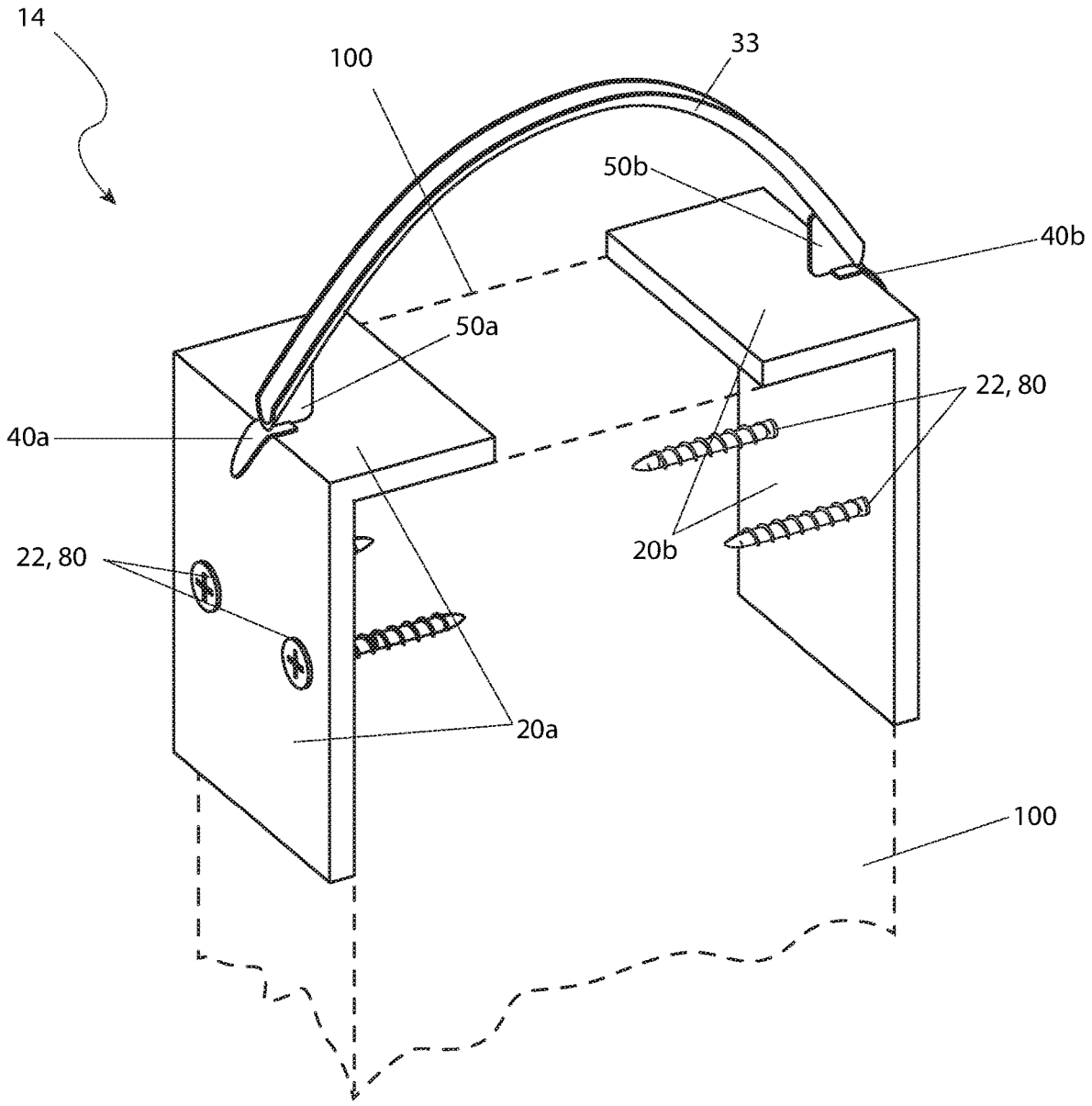
FIG. 6 is a perspective view of a gate latch accessory aid 14, according to a fourth alternate embodiment of the present invention.
Figure 7:
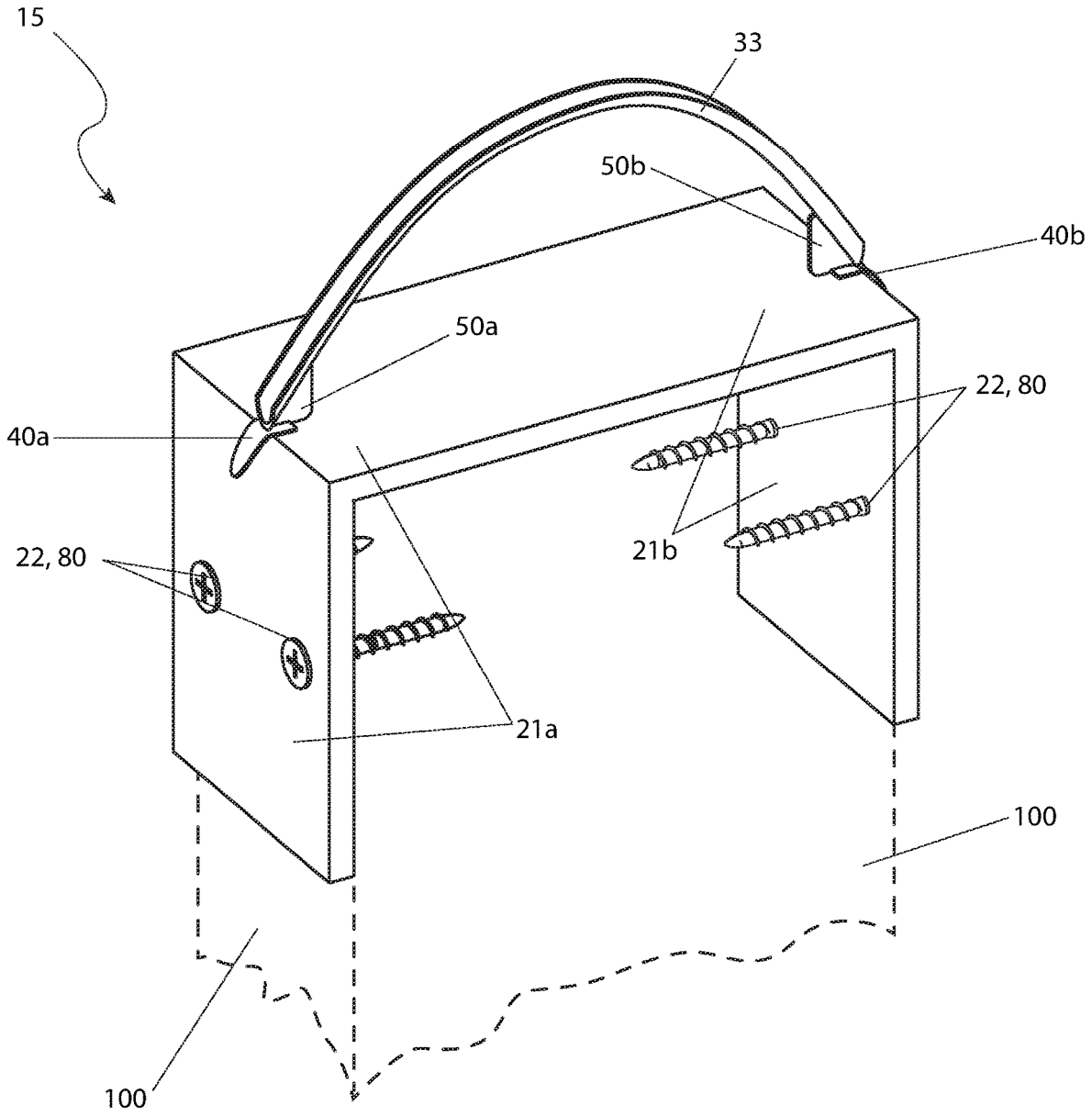
FIG. 7 is a perspective view of a gate latch accessory aid 15, according to a fifth alternate embodiment of the present invention; and, FIG. 8 is a perspective view of a gate latch accessory aid 16, according to a sixth alternate embodiment of the present invention.

It is envisioned that the guide tube 30 may also take on an arcuate half tube or half pipe form 33, 33*a* and 33*b*, having an open top portion to receive and cradle the rope/cable 110 with equal benefit, and as such should not be interpreted as a limiting factor of the device 10 (please see FIGS. 5-7).

The device 10 is also envisioned to include post eyelet 120 and latching mechanism 130 portions (see FIG. 2).

Referring now to FIG. 2, an environmental side view of the device 10, according to the preferred embodiment of the present invention, is disclosed. In use, the device 10 is to be mounted to opposing top edge portions of an existing fence post 100 using a plurality of fasteners 80. A rope/cable 110 is then routed through the guide tube portion 30 of the device 10. One (1) end of the rope/cable 110 is tied or otherwise affixed to a post eyelet 120 being screwed into, or otherwise secured to a side surface of the fence post 100 directly below one (1) end portion of the guide tube 30. The location of the post eyelet 120 should be such that a sufficient length of the rope/cable 110 may be exposed so as to enable grasping and extending the rope/cable 110. The other end of the rope/cable 110 is secured in like manner to a latching mechanism 130 mounted to a side surface of the fence post 100 opposite that of the post eyelet 120. An embodiment of the latching mechanism 130 is illustrated here, for example sake, being a pivoting-type design having an integral latch eyelet portion 132, a latch hook portion 134, and a latch mounting plate 136. However, it is understood that other latching mechanisms of various designs may be used with equal benefit, and as such should not be interpreted as a limiting factor of the device 10.

Figure 3:
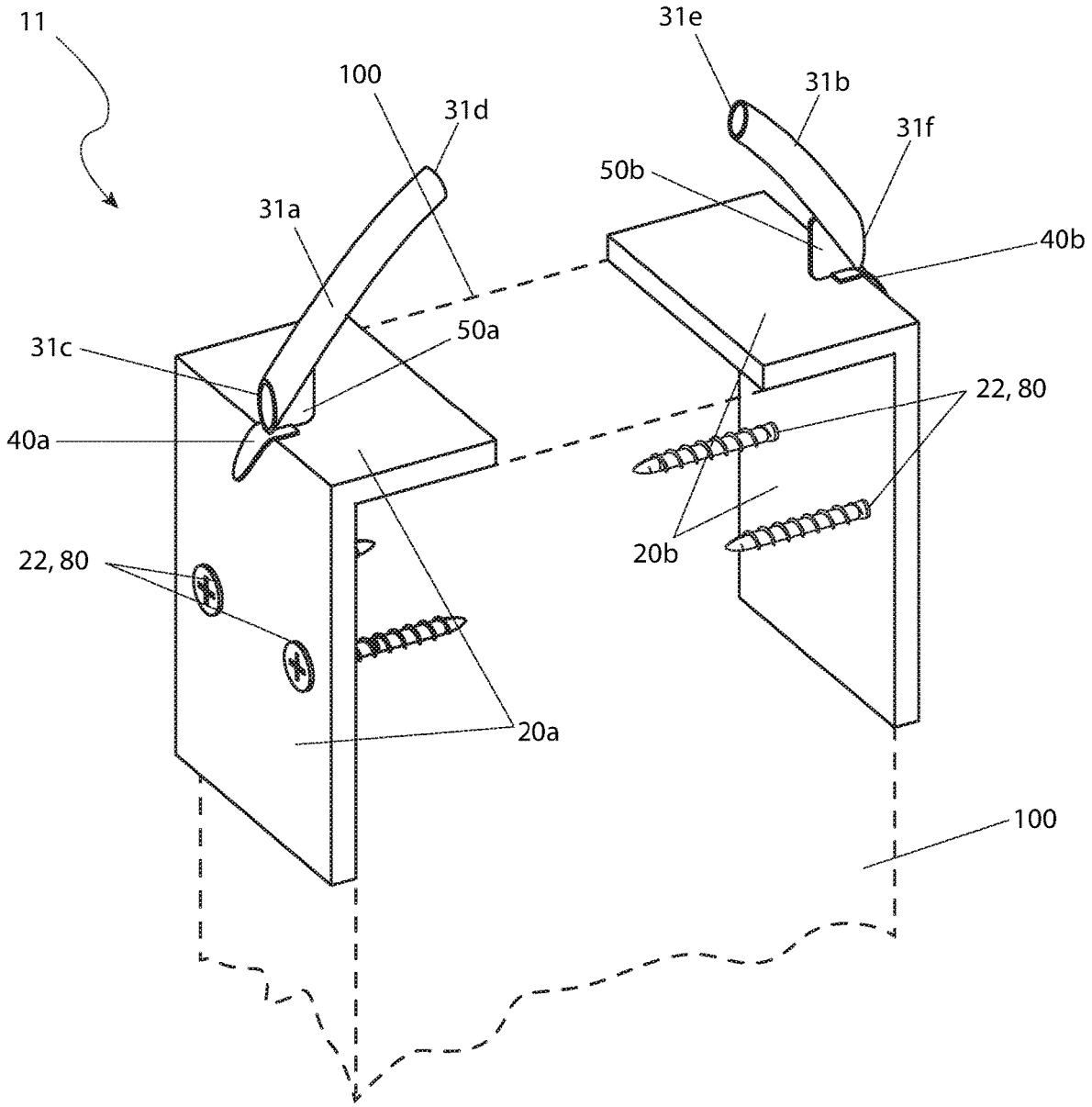
FIG. 3 is a perspective view of a gate latch accessory aid 11, according to a first alternate embodiment of the present invention.

Referring now to FIG. 3, a perspective view of the device 11, according to a first alternate embodiment of the present invention, is disclosed. The device 11 includes a unitary plastic or metal structure including a first mounting bracket 20*a*, a mirror-image second mounting bracket 20*b*, and severed guide tube having a first half 31*a* and a second half 31*b*. The mounting brackets 20*a*, 20*b* are envisioned to take on mirror-image "L"-shaped forms for convenient positioning and attachment along opposing top edge portions of an existing fence post 100. The parallel vertical portions of the mounting brackets 20*a*, 20*b* include a plurality of formed or machined fastener apertures 22 allowing the device 10 to be affixed to the fence post 100 using corresponding fasteners 80 such as wood screws, lag screws, or the like. The guide tubes 31*a*, 31*b* are affixed to, opposing top corner portions of the mounting brackets 20*a*, 20*b* in an upwardly arcing manner, being welded or otherwise permanently joined thereto. The hollow guide tubes 31*a* and 31*b* each provide a pair of internal guide tube apertures 31*c*, 31*d*, 31*e* and 31*f* across the length of both tubes 31*a* and 31*b*, being sized so as to allow insertion and free motioning of a rope/cable 110 through the guide tubes 31*a* and 31*b* during use. It is envisioned that the device 11 may be sold in different sizes having different widths between the brackets 20*a*, 20*b* to fit snuggly upon various standard sizes of fence posts 100 such as four by four inches (4×4 in.), four by six inches (4×6 in.), and the like.

A pair of tongues 40*a*, 40*b*, each of which is located at the transition of the angle portion of each of the mounting brackets 20*a*, 20*b*, directly subjacent to a distal exit port 31*c*, 31*f* of the guide tubes 31*a*, 31*b* respectively. The tongues 40*a*, 40*b* exist to help further create a smooth and non-fraying contact point for the rope/cable 110. Also, a pair of gusset plates 50*a*, 50*b*, each of which is positioned to help support a distal end of the guide tubes 31*a*, 31*b* to the upper horizontal portions for a respective mounting bracket 20*a*, 20*b*.

Figure 4:
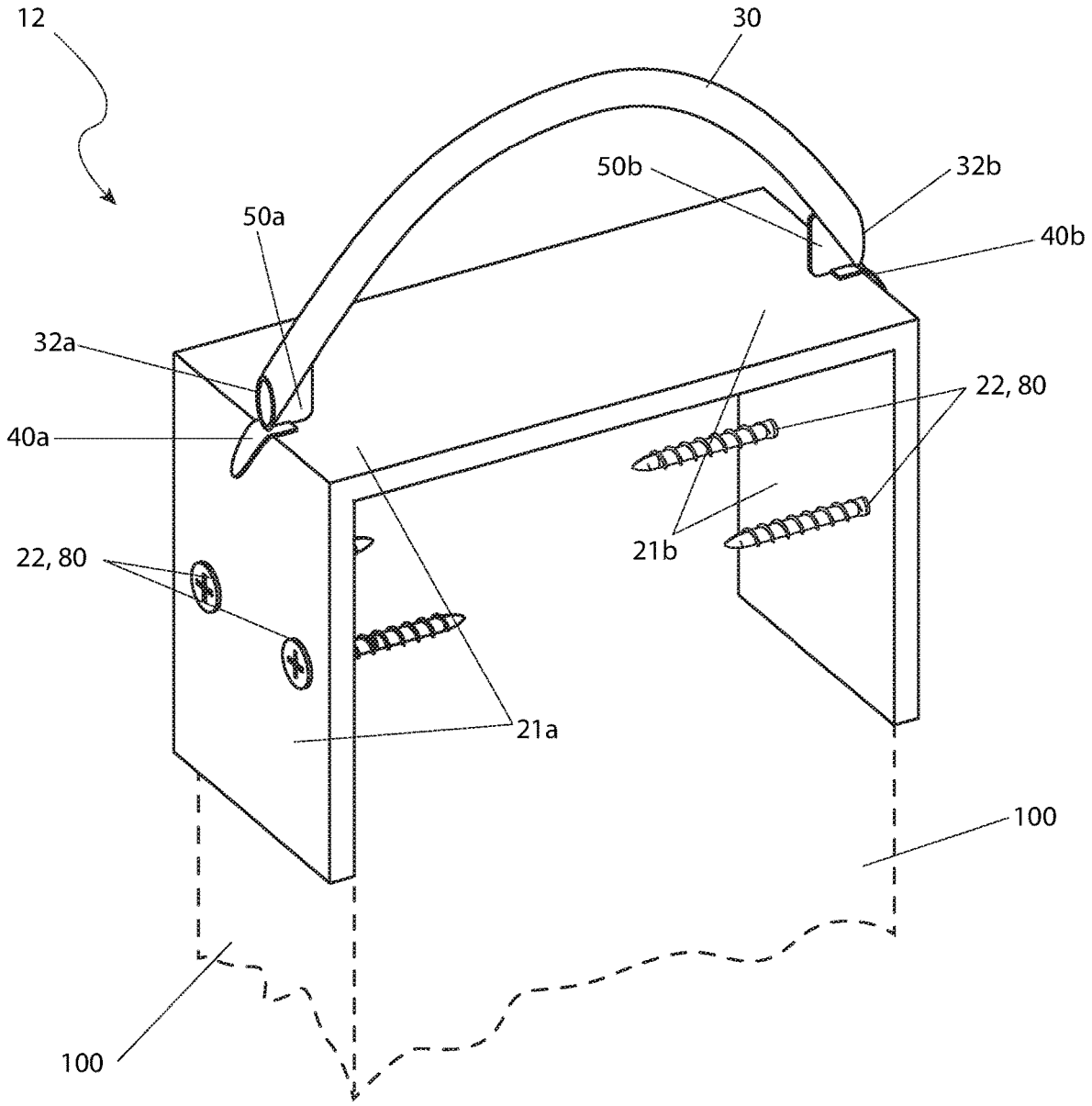
FIG. 4 is a perspective view of a gate latch accessory aid 12, according to a second alternate embodiment of the present invention.

Referring now to FIG. 4, a perspective view of the device 12, according to a second alternate embodiment of the present invention, is disclosed. The device 12 includes a unitary plastic or metal structure including a single mounting bracket 20*c* having a first mounting bracket side 21*a*, a mirror-image second mounting bracket side 21*b*, and a guide tube 30 having a first aperture 32*a* and a second aperture 32*b*. The sides of the mounting brackets 21*a*. 21*b* are envisioned to take on mirror-image "L"-shaped forms for convenient positioning and attachment along opposing top edge portions of an existing fence post 100. The parallel vertical portions of the mounting bracket 20*c* sides 21*a*, 21*b* include a plurality of formed or machined fastener apertures 22 allowing the device 10 to be affixed to the fence post 100 using corresponding fasteners 80 such as wood screws, lag screws, or the like. The guide tube 30 is affixed to, and extends between opposing top corner portions of the mounting brackets 21*a*, 21*b* in an upwardly arcing manner, being welded or otherwise permanently joined thereto. The guide tube 30 is affixed to, and extends between opposing top corner portions of the mounting brackets 20*a*, 20*b* in an upwardly arcing manner, being welded or otherwise permanently joined thereto. The hollow guide tube 30 provides a pair of internal guide tube apertures 32*a*, 32*b* through its length, being sized so as to allow insertion and free motioning of a rope/cable 110 through the guide tube 30 during use (see FIG. 2). It is envisioned that the device 10 may be sold in different sizes having different widths between the brackets 20*a*, 20*b* to fit snuggly upon various standard sizes of fence posts 100 such as four by four inches (4×4 in.), four by six inches (4×6 in.), and the like.

A pair of tongues 40*a*, 40*b*, each of which is located at the transition of the angle portion of each of the mounting brackets sides 21*a*, 21*b*, directly subjacent to a distal exit port of the guide tube 30. The tongues 40*a*, 40*b* exist to help further create a smooth and non-fraying contact point for the rope/cable 110. Also, a pair of gusset plates 50*a*, 50*b*, each of which is positioned to help support a distal end of the guide tube 30 to the upper horizontal portions for a respective mounting bracket sides 21*a*, 21*b*.

Referring now to FIG. 5, a perspective view of the device 13, according to a third alternate embodiment of the present invention, is disclosed. The device 13 includes a unitary plastic or metal structure including a first mounting bracket 20*a*, a mirror-image second mounting bracket 20*b*, and a first guide half-pipe 33*a* and second guide half-pipe 33*b*. The mounting brackets 20*a*. 20*b* are envisioned to take on mirror-image "L"-shaped forms for convenient positioning and attachment along opposing top edge portions of an existing fence post 100. The parallel vertical portions of the mounting brackets 20*a*, 20*b* include a plurality of formed or machined fastener apertures 22 allowing the device 10 to be affixed to the fence post 100 using corresponding fasteners 80 such as wood screws, lag screws, or the like. The guide half-pipes 33*a*, 33*b* are affixed to, opposing top corner portions of the mounting brackets 20*a*, 20*b* in an upwardly arcing manner, being welded or otherwise permanently joined thereto. It is envisioned that the device 13 may be sold in different sizes having different widths between the brackets 20*a*, 20*b* to fit snuggly upon various standard sizes of fence posts 100 such as four by four inches (4×4 in.), four by six inches (4×6 in.), and the like.

A pair of tongues 40*a*, 40*b*, each of which is located at the transition of the angle portion of each of the mounting brackets 20*a*, 20*b*, directly subjacent to a distal exit port of the first half-pipe guide 33*a* and second half-pipe guide 33*b*. The tongues 40*a*, 40*b* exist to help further create a smooth and non-fraying contact point for the rope/cable 110. Also, a pair of gusset plates 50*a*, 50*b*, each of which is positioned to help support a distal end of the first half-pipe guide 33*a* and second half-pipe guide 33*b* to the upper horizontal portions for a respective mounting bracket 20*a*, 20*b*.

Referring now to FIG. 6, a perspective view of the device 14, according to a fourth alternate embodiment of the present invention, is disclosed. The device 10 includes a unitary plastic or metal structure including a first mounting bracket 20*a*, a mirror-image second mounting bracket 20*b*, and an interconnecting guide half-pipe 33. The mounting brackets 20*a*. 20*b* are envisioned to take on mirror-image "L"-shaped forms for convenient positioning and attachment along opposing top edge portions of an existing fence post 100. The parallel vertical portions of the mounting brackets 20*a*, 20*b* include a plurality of formed or machined fastener apertures 22 allowing the device 10 to be affixed to the fence post 100 using corresponding fasteners 80 such as wood screws, lag screws, or the like. The half-pipe guide 33 is affixed to, and extends between opposing top corner portions of the mounting brackets 20*a*, 20*b* in an upwardly arcing manner, being welded or otherwise permanently joined thereto. It is envisioned that the device 14 may be sold in different sizes having different widths between the brackets 20*a*, 20*b* to fit snuggly upon various standard sizes of fence posts 100 such as four by four inches (4×4 in.), four by six inches (4×6 in.), and the like.

A pair of tongues 40*a*, 40*b*, each of which is located at the transition of the angle portion of each of the mounting brackets 20*a*, 20*b*, directly subjacent to a distal exit port of half-pipe guide 33. The tongues 40*a*, 40*b* exist to help further create a smooth and non-fraying contact point for the rope/cable 110. Also, a pair of gusset plates 50*a*, 50*b*, each of which is positioned to help support a distal end of the half-pipe guide 33 to the upper horizontal portions for a respective mounting bracket 20*a*, 20*b*.

Referring now to FIG. 7, a perspective view of the device 15, according to a fifth alternate embodiment of the present invention, is disclosed. The device 12 includes a unitary plastic or metal structure including a single mounting bracket 20 having a first mounting bracket side 20*a*, a mirror-image second mounting bracket side 20*b*, and a guide half-pipe 33. The sides of the mounting brackets 20*a*. 20*b* are envisioned to take on mirror-image "L"-shaped forms for convenient positioning and attachment along opposing top edge portions of an existing fence post 100. The parallel vertical portions of the mounting bracket 20 sides 20*a*, 20*b* include a plurality of formed or machined fastener apertures 22 allowing the device 10 to be affixed to the fence post 100 using corresponding fasteners 80 such as wood screws, lag screws, or the like. The guide half-pipe 33 is affixed to, and extends between opposing top corner portions of the mounting brackets 20*a*, 20*b* in an upwardly arcing manner, being welded or otherwise permanently joined thereto. It is envisioned that the device 15 may be sold in different sizes having different widths between the brackets 20*a*, 20*b* to fit snuggly upon various standard sizes of fence posts 100 such as four by four inches (4×4 in.), four by six inches (4×6 in.), and the like.

A pair of tongues 40*a*, 40*b*, each of which is located at the transition of the angle portion of each of the mounting brackets 20*a*, 20*b*, directly subjacent to a distal exit port of the guide half-pipe 33. The tongues 40*a*, 40*b* exist to help further create a smooth and non-fraying contact point for the rope/cable 110. Also, a pair of gusset plates 50*a*, 50*b*, each of which is positioned to help support a distal end of the guide half-pipe 33 to the upper horizontal portions for a respective mounting bracket 20*a*, 20*b*.

Figure 8:
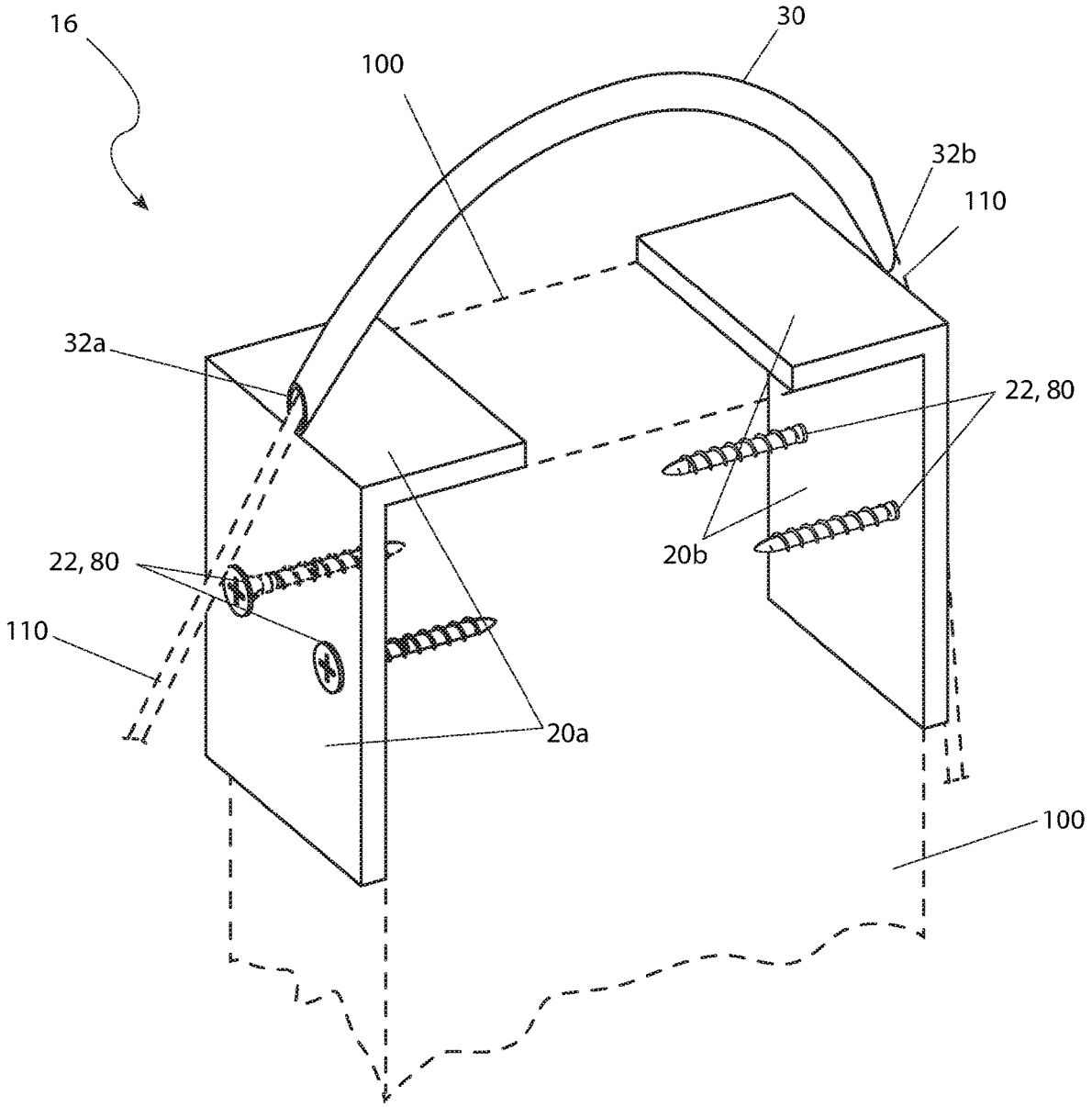

Referring now to FIG. 8, a perspective view of the device 16, according to a sixth alternate embodiment of the present invention, is disclosed. This embodiment is essentially the same as that of the preferred embodiment FIG. 1, but that device 16 has a tube 30 which is secured to the first mounting bracket 20*a* and second mounting bracket 20*b* without use of a tongue 40*a*, 40*b* and a gusset 50*a*, 50*b*. In this embodiment, it is envisioned that the tube 30 would be secured to the first mounting bracket 20*a* and second mounting bracket 20*b* beneath first aperture 32*a* and second aperture 32*b* by means of a weldment, industrial adhesive or any other means commonly employed by those in the industry.

It is envisioned that other styles and configurations of the present invention can be easily incorporated into the teachings of the present invention, and only one particular configuration shall be shown and described for purposes of clarity and disclosure and not by way of limitation of scope.

The preferred embodiment 10, and alternate embodiments 11-16, of the present invention can be utilized by the common user in a simple and effortless manner with little or no training After initial purchase or acquisition of the device 10, it would be installed as indicated in FIG. 2.

The method of installing and utilizing the preferred embodiment 10, and alternate embodiments 11-16, may be achieved by performing the following steps: procuring a model of the device 10-16 having a width which corresponds to a size of an intended fence post 100; positioning the bracket 20*c* or bracket portions 20*a*, 20*b* upon a top face or opposing top corner portions of the fence post 100; utilizing the bracket aperture portions 32*a*, 32*b* or 31*c*, 31*d*, 31*e*, and 31*f* when applicable and the provided fasteners 80 to mount the bracket 20*c* or brackets 20*a*, 20*b* to the opposing side surfaces of the fence post 100; screwing or otherwise installing the post eyelet 120 upon a side surface of the fence post 100 directly below one (1) end of the guide tube 30, or half-pipe 33, 33*a* and 33*b*, at a height which will result in a sufficient length of the rope/cable 110 to be exposed for grasping and extending during use; mounting the latching mechanism 130 in like manner upon an opposing side surface of the fence post 100 at a desired height and directly below the other end of the guide tube 30, or half-pipe 33, 33*a* and 33*b* using the provided fasteners 80; inserting and routing a length of rope/cable 110 through the guide tube 30 or on the half-pipe guide 33, 33*a* or 33*b*; tying or otherwise affixing one (1) end of the rope/cable 110 to the post eyelet 120; tying or otherwise affixing the other end of the rope/cable 110 to the latching mechanism eyelet 132; allowing the latching mechanism 130 to secure an existing gate portion of the gate system in a normal manner; grasping the rope/cable 110 immediately above the post eyelet 120; pulling and extending the rope/cable 110 out through the guide tube 30, coincidentally lifting the latching mechanism 130 and releasing the gate portion; and, benefiting from protection of gate and rope/cable 110 portions of a gate system afforded a user of the preferred embodiment 10, and alternate embodiments 11-16.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A gate latch accessory aid, comprising:

a first mounting bracket adapted to be mounted to a first top side edge of a fence post;

a second mounting bracket adapted to be mounted to a second top side edge of said fence post opposite said first mounting bracket;

a guide having a first end secured to a top side face of said first mounting bracket and a second end secured to a top side face of said second mounting bracket spanning a distance between said first mounting bracket and said second mounting bracket;

a post eyelet adapted to be mounted to a fence post first side subjacent to said first mounting bracket capable of enabling routing a cable therethrough;

a latching mechanism adapted to be mounted to a fence post second side opposite said post eyelet subjacent from said second mounting bracket further having a latch eyelet capable of retaining a distal end of said cable therein;

a first gusset further securing said guide first end to said top side face of said first mounting bracket; and a second gusset further securing said guide second end to said top side face of said second mounting bracket;

wherein said guide is adapted to support and allow free motioning of said cable there through.

2. The gate latch accessory aid of claim 1, wherein said guide comprises a tubular member having an upward arch configured to enable insertion of said cable there through.

3. The gate latch accessory aid of claim 1, wherein said first mounting bracket and said second mounting bracket each comprise an L-shape.

4. The gate latch accessory aid of claim 1, comprising:

a first tongue secured upon a top side face corner of said first mounting bracket and subjacent said guide first end; and a second tongue secured upon a top side face corner of said second mounting bracket and subjacent said guide second end.

5. The gate latch accessory aid of claim 4, wherein said guide comprises a tubular member having an upward arch configured to enable insertion of said cable there through.

6. The gate latch accessory aid of claim 4, wherein said first mounting bracket and said second mounting bracket each comprise an L-shape.

7. A gate latch accessory aid, comprising:

a mounting bracket having a first side and a second side adapted to be mounted to a first top side edge of a fence post;

a guide having a first end secured to a top side face of said mounting bracket first side and a second end secured to a top side face of said mounting bracket second side;

a post eyelet adapted to be mounted to a fence post first side, subjacent to said first mounting bracket capable of enabling routing a cable therethrough; and a latching mechanism adapted to be mounted to a fence post second side opposite said post eyelet subjacent from said second mounting bracket further having a latch eyelet capable of retaining a distal end of said cable therein;

a first gusset further securing said guide first end to said top side face of said mounting bracket first side;

a second gusset further securing said guide second end to said top side face of said mounting bracket second side;

a first tongue secured upon a top side face corner of said mounting bracket first side and subjacent said guide first end; and a second tongue secured upon a top side face corner of said mounting bracket second side and subjacent said guide second end;

wherein said guide is adapted to support and allow free motioning of said cable there through.

8. The gate latch accessory aid of claim 7, wherein said guide comprises a tubular member having an upward arch; wherein said cable is inserted therethrough.

9. The gate latch accessory aid of claim 7, wherein said mounting bracket comprises a C-shape.

10. The gate latch accessory aid of claim 7, wherein said mounting bracket, said guide, said first gusset, said second gusset, said first tongue and said second tongue are integrally molded.

* * * * *